US010359200B2

(12) United States Patent
Braden et al.

(10) Patent No.: US 10,359,200 B2
(45) Date of Patent: Jul. 23, 2019

(54) HOME APPLIANCE HAVING A FLUE GAS AIR DIVERTER

(71) Applicants: BSH Home Appliances Corporation, Irvine, CA (US); BSH Hausgeräte GmbH, Munich (DE)

(72) Inventors: Ben Braden, Lafollette, TN (US); Robert Ladner, Knoxville, TN (US); Richard Moyers, Morristown, TN (US); Charles Osborne, Speedwell, TN (US); Timothy Russell, Jacksboro, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 516 days.

(21) Appl. No.: 14/812,052

(22) Filed: Jul. 29, 2015

(65) Prior Publication Data

US 2017/0030589 A1 Feb. 2, 2017
US 2018/0363921 A9 Dec. 20, 2018

Related U.S. Application Data

(63) Continuation-in-part of application No. 14/603,473, filed on Jan. 23, 2015, now Pat. No. 9,857,085.

(51) Int. Cl.

| | |
|---|---|
| ***F23L 11/00*** | (2006.01) |
| ***F24C 15/20*** | (2006.01) |
| ***F24C 15/00*** | (2006.01) |
| ***F24C 15/32*** | (2006.01) |

(52) U.S. Cl.
CPC ..... *F24C 15/2007* (2013.01); *F24C 15/006* (2013.01); *F24C 15/2028* (2013.01); *F24C 15/32* (2013.01)

(58) Field of Classification Search
CPC ..... F24C 15/2007; F24C 15/006; F24C 15/32
See application file for complete search history.

(56) References Cited

U.S. PATENT DOCUMENTS

| | | | |
|---|---|---|---|
| 1,706,389 | A | 3/1929 | Bayliss |
| 2,158,881 | A | 5/1939 | McCormick |
| 2,376,571 | A | 5/1945 | Brumnaugh |

(Continued)

FOREIGN PATENT DOCUMENTS

| | | |
|---|---|---|
| EP | 0671591 B1 | 9/1995 |
| EP | 2489942 A1 | 8/2012 |

(Continued)

OTHER PUBLICATIONS

Draglink, Open Roads Forum, RV.net, Mar. 22, 2011, p. 22.

(Continued)

*Primary Examiner* — Jason Lau
(74) *Attorney, Agent, or Firm* — Michael E. Tschupp; Andre Pallapies; Brandon G. Braun

(57) ABSTRACT

A home cooking appliance includes a housing having a cooktop surface on a top of the housing, a burner on the cooktop surface, a cooking grate disposed above the burner, a cooking compartment in the housing, an oven flue that exhausts air from the cooking compartment, and a flue gas air diverter configured to divert the air exiting from the oven flue under a portion of the cooking grate.

28 Claims, 16 Drawing Sheets

(56) References Cited

U.S. PATENT DOCUMENTS

| | | | | |
|---|---|---|---|---|
| 2,526,890 | A | 10/1950 | Mendel | |
| 2,743,719 | A | 5/1956 | Reeves | |
| 3,290,483 | A | 12/1966 | Hurko | |
| 3,499,430 | A | 3/1970 | Kemp | |
| 3,499,431 | A | 3/1970 | McArthur, Jr. | |
| 3,682,156 | A | 8/1972 | Perl | |
| 3,783,854 | A | 1/1974 | Hurko et al. | |
| 3,832,988 | A | 9/1974 | Doner | |
| 3,883,854 | A | 5/1975 | Heinberg et al. | |
| 4,179,261 | A * | 12/1979 | Riehl | F23D 14/045 431/286 |
| 4,184,473 | A | 1/1980 | Mcintire et al. | |
| 4,207,863 | A * | 6/1980 | Drouin | F24C 15/006 126/198 |
| 4,383,518 | A | 5/1983 | Beausoleil | |
| 4,527,542 | A | 7/1985 | Bales et al. | |
| 4,598,691 | A * | 7/1986 | Herrelko | F24C 15/2007 126/19 R |
| 4,665,893 | A | 5/1987 | Miyagawa et al. | |
| 4,763,638 | A | 8/1988 | Hurley et al. | |
| 4,865,010 | A * | 9/1989 | Kett | F24C 15/006 126/21 R |
| 5,158,065 | A | 10/1992 | Lee et al. | |
| 6,172,338 | B1 | 1/2001 | Barnes et al. | |
| 6,761,159 | B1 * | 7/2004 | Barnes | F24C 15/2007 126/15 R |
| 7,762,250 | B2 | 7/2010 | Elkasevic et al. | |
| 7,923,663 | B2 | 4/2011 | Kim et al. | |
| 8,333,183 | B2 | 12/2012 | Nam et al. | |
| 8,450,656 | B2 | 5/2013 | Doyal et al. | |
| 2007/0158328 | A1 * | 7/2007 | Kim | F24C 15/2007 219/391 |
| 2011/0067684 | A1 | 5/2011 | Kwag et al. | |
| 2012/0204855 | A1 * | 8/2012 | Huber | F24C 15/2035 126/299 R |
| 2013/0125764 | A1 | 5/2013 | Jeong et al. | |
| 2016/0215987 | A1 | 7/2016 | Braden et al. | |
| 2016/0215988 | A1 | 7/2016 | Braden et al. | |

FOREIGN PATENT DOCUMENTS

| | | | |
|---|---|---|---|
| KR | 100272362 | B1 | 12/2000 |
| WO | 2013098251 | A1 | 7/2013 |

OTHER PUBLICATIONS

Nikhil Mashruwala, National Search Report U.S. Appl. No. 14/603,472 dated Dec. 12, 2016.

Nikhil Mashruwala, National Search Report U.S. Appl. No. 14/603,473 dated Dec. 1, 2016.

* cited by examiner

HOME APPLIANCE HAVING A FLUE GAS AIR DIVERTER

CROSS-REFERENCE TO RELATED APPLICATIONS

This application is a Continuation-in-part application of co-pending U.S. application Ser. No. 14/603,472, filed on Jan. 23, 2015, and a Continuation-in-part application of co-pending U.S. application Ser. No. 14/603,473, filed on Jan. 23, 2015, for which priority is claimed under 35 U.S.C. § 120, the entire contents of the above identified patent applications are hereby incorporated by reference.

FIELD OF THE INVENTION

The present invention is directed to a home cooking appliance having a rear vent trim, and more particularly, to a home cooking appliance having a rear vent trim including a flue gas air diverter.

BACKGROUND OF THE INVENTION

A conventional home cooking appliance, such as a Free Standing Range (FSR), includes a housing having a cooking compartment, such as a baking oven, convection oven, steam oven, warming drawer, etc., and a cooking surface formed, for example, by cooking grates disposed over gas burners on top of the housing. A conventional range (e.g., slide-in, free standing, etc.) is installed in a cooking area of a home kitchen with a rear wall of the appliance facing a back wall of the kitchen. The appliance typically is disposed between counters with floor cabinets below the counters. The kitchen may include wall cabinets mounted on the back wall of the kitchen either over the cooking surface of the range or over the adjacent floor cabinets, and/or another appliance or component, such as an over-the-range (OTR) microwave oven or an OTR convection microwave oven over the cooking surface.

Industry standards and regulations commonly dictate acceptable temperatures of the combustible back wall behind the appliance, acceptable temperatures of cabinets or components over the range or adjacent to the range, as well as acceptable door and other surface temperatures for the appliance, during high temperature events, such as during a normal baking and/or self-cleaning cycle of the oven while all burners on the cooktop are on a highest heat setting. The appliance must be able to exhaust cooling air and flue gases from the cooking compartment to maintain acceptable door temperatures of the appliance, acceptable surface temperatures of the appliance, acceptable temperatures of a combustible back wall behind the appliance, and acceptable temperatures of cabinets or components over the range or adjacent to the range.

Conventional appliances include various structures and techniques designed to manage and dissipate the hot air being exhausted from the appliance while complying with industry standards and regulations. In order to provide enough air flow through the appliance to maintain acceptable surface temperatures and oven door temperatures and to protect components in and around the appliance, many conventional appliances use costly designs and door construction that increase the air flow through the door and the housing, and/or use greater air flow and louder fans. Additionally, conventional home cooking appliances typically require a rear wall of the appliance to be spaced from the combustible back wall of the home kitchen by a certain minimal amount of clearance in order to manage and dissipate hot air from the appliance in order to improve compliance with the industry standards and regulations.

For example, a conventional Free Standing Range (FSR) may be provided with a rear vent trim kit or assembly, which adapts the FSR for the environment in which the FSR is placed. The FSR may include an "island" trim kit which adapts the FSR for installation in an island location, or a "low back" trim kit which adapts the FSR for placement with a rear wall of the appliance adjacent to a back wall of a home kitchen. A low back trim kit may be arranged to space the FSR away from the back wall so that air is permitted to circulate between the back wall to keep the back wall cooler than the FSR and also to provide a space into which exhaust gases and/or cooling ventilation from the FSR may be vented upward from the appliance. The FSR can include one or more ventilation fan outlets from which the FSR exhausts cooling air. The temperature differences in the air in the space protected by the conventional low back trim kit enables a convection of air to be established in a vertical direction from the fan outlets upward into the low back trim kit and the air is guided out a vent trim opening in an upper surface of the rear vent trim kit.

SUMMARY OF THE INVENTION

An exemplary embodiment of the invention comprises a home cooking appliance including a housing having a cooktop surface on a top of the housing, a burner on the cooktop surface, a cooking grate disposed above the burner, a cooking compartment in the housing, an oven flue that exhausts air from the cooking compartment, and a flue gas air diverter configured to divert the air exiting from the oven flue under a portion of the cooking grate. In this way, one or more flue gas air diverters divert hot air (i.e., flue gases) exiting from the cooking compartment under the cooking grates and away from the back wall of the kitchen, thereby reducing an amount of heat transferred from the hot air flowing from an exhaust channel of one or more oven flues to the back wall of the kitchen, which results in significantly lower surface temperatures on the back wall of the kitchen during operation of the cooking appliance compared to conventional arrangements, for example, which permit the hot flue gas to exit straight upward from the appliance. As a result, the present invention can minimize or eliminate a required minimum clearance between the rear wall of the appliance and a back wall of the kitchen, which faces the rear wall of the appliance, while at the same time maintaining compliance with industry standards and regulations, thereby enabling the cooking appliance to be installed with a 0" clearance to a combustible surface, such as the back wall of the kitchen, while complying with industry standards and regulations.

Other features and advantages of the present invention will be described below. To provide a better understanding of the invention, and for further clarification and background of the present invention, various aspects and considerations of a home cooking appliance having a flue gas air diverter, which have been recognized by the present invention, first will be explained in greater detail.

As explained above, a home cooking appliance, such as a Free Standing Range (FSR), may be provided with a rear vent trim or assembly, which adapts the appliance for the environment in which the appliance is placed. A rear vent trim can take various forms depending on the particular appliance, arrangement of cooking compartment(s), cooktop or burners, desired aesthetics of the appliance, and/or the location in which the appliance will be installed, such as adjacent to a kitchen wall, in a kitchen island, adjacent to cabinetry or other accessories such as a fume hood, etc., among other things. For example, the rear vent trim can be configured to be raised up from the cooking surface by various amounts such as a high back, low back, high shelf, etc., or configured to be substantially flush with the top of the appliance or cooking surface.

The rear vent trim can include one or more vent openings for exhausting air from within the appliance. The conventional rear trim kit commonly is located at a top, rear portion of the appliance and permits air exhausting from the appliance, such as hot flue gases exhausting from the oven compartment and cooling air exhausting from within the appliance, to exit upward out of the vent openings at the rear of the appliance. Some conventional appliances are configured to be positioned such that the rear wall is close to a combustible surface, such as a back wall of a kitchen. During operation of such conventional appliances, the hot air/flue gases exhaust from the oven compartment and exit upward out of the vent openings at the rear of the appliance along the back wall of the kitchen. The hot air/flue gases can transfer heat to the back wall of the kitchen, thereby undesirably increasing a temperature of a surface of the back wall of the kitchen and exceeding industry standards and regulations. As a result, conventional home cooking appliances commonly require a minimum clearance or spacing between the rear wall of the installed appliance and a back wall of the kitchen in order to maintain compliance with industry standards and regulations. The temperature of the back wall of the kitchen during operation of the appliance greatly affects an amount of the required minimum clearance between the rear wall of the appliance and the back wall of the kitchen in order to minimize heat transfer to the back wall of the kitchen and maintain compliance with industry standards and regulations.

A built-in appearance of the appliance is very desirable to many users. The present invention recognizes that the required clearance between the rear wall of conventional home cooking appliances and a back wall of the kitchen results in an aesthetically undesirable appearance owing to a space or gap between the rear vent trim and/or rear wall of the appliance and the back wall of the kitchen, which takes away from or lessens the built-in appearance of the appliance desired by many users. The required clearance between the rear wall of conventional home cooking appliances and a back wall of the kitchen also may increase a likelihood of miscellaneous items falling or being trapped between the rear vent trim and/or rear wall of the conventional home cooking appliance and the back wall of the kitchen.

These problems and others are addressed by the present invention, which provides a home cooking appliance including a housing having a cooktop surface on a top of the housing, a burner on the cooktop surface, a cooking grate disposed above the burner, a cooking compartment in the housing, an oven flue that exhausts air from the cooking compartment, and a flue gas air diverter configured to divert the air exiting from the oven flue under a portion of the cooking grate. In this way, one or more flue gas air diverters can divert the hot air (i.e., flue gases) exiting from the cooking compartment under the cooking grates and away from the back wall of the kitchen, thereby reducing an amount of heat transferred from the hot air to the back wall of the kitchen, which results in much lower surface temperatures on the back wall of the kitchen during operation of the cooking appliance compared to conventional arrangements, for example, which permit the hot air (i.e., flue gas) to exit straight upward from the rear vent trim of the appliance. As a result, the present invention can minimize or eliminate a required minimum clearance between the rear wall of the appliance and a back wall of the kitchen, while at the same time maintaining compliance with industry standards and regulations, thereby enabling the home cooking appliance according to the present invention to be installed with a 0" clearance to a combustible surface, such as the back wall of the kitchen, while complying with industry standards and regulations.

According to exemplary embodiments of the invention, the rear vent trim having a flue gas air diverter can be configured to control and manage the flow of the hot air (e.g., hot flue gas) exhausting from the cooking compartment as well as to control and manage the flow of cooling air exiting from within the appliance to minimize temperatures on adjacent surfaces, such as surfaces of a back wall of the kitchen, surfaces of kitchen countertops adjacent to the appliance, surfaces of kitchen cabinetry adjacent to or above the appliance, etc. Particularly, the rear vent trim having a flue gas air diverter can be configured to divert the flow of the hot air (e.g., hot flue gas) exhausting from the cooking compartment under the cooking grates and away from the back wall of the kitchen while permitting or guiding the cooling air exiting from within the appliance to flow upward along the back wall of the kitchen, thereby creating a wash of cooler air that may further prevent hot air from flowing close to the back wall, which may reduce or prevent heat transfer from the hot air to the back wall. In this way, the present invention can provide a rear vent trim that controls a flow of hot air exhausting from the cooking compartment of the appliance and a flow of cooling air exiting from within the appliance, thereby limiting or reducing the temperature exposure to a back wall of the kitchen to which the wall of the appliance is adjacent. The present invention also can minimize or altogether eliminate a required minimum clearance between the rear wall of the appliance and a back wall of the kitchen, while maintaining compliance with industry standards and regulations, thereby enabling the cooking appliance to be installed with a 0" clearance to the back wall of the kitchen while complying with industry standards and regulations.

The flue gas air diverter can be positioned on a surface of the rear wall (e.g., an inner surface of the rear wall), such as a surface that is adjacent to or that directly faces an exhaust channel (e.g., an oven flue exhaust) of the oven cooking compartment. The flue gas air diverter can be mounted directly to the rear wall of the appliance, or spaced from the rear wall and configured to have an air gap between the flue gas air diverter and an inner surface of the rear wall of the appliance. The air gap can reduce an amount of heat that is transferred from the flue gas air diverter (which may be heated by the hot air that flows from the oven flue through the exhaust channel) to the rear wall. As a result, during operation of the cooking appliance, a temperature of the rear wall is less than a temperature of the flue gas air diverter, which in turn limits or reduces the temperature exposure to a back wall of the kitchen to which the wall of the appliance is adjacent. More particularly, the flue gas air diverter can be configured to loosely contact the rear wall, or to be spaced by a minimal amount or clearance from the rear wall (e.g., entirely spaced apart) using one or more fixation devices. As a result, the heat transfer from one solid to another solid (e.g., metal to metal) can be substantially limited to heat transferred through one or more fixation devices, such as rivets, screws, or the like. In some example embodiments, the flue gas air diverter can be mounted on the appliance such that the flue gas air diverter does not contact, or is substantially free of contact with, the rear wall of the appliance, thereby minimizing or preventing the rear wall from conducting heat from the flue gas air diverter. In this way, the exemplary embodiments of the flue gas air diverter can significantly reduce the temperature of the rear wall and rear vent trim assembly of the cooking appliance. This arrangement also may limit or reduce an amount of heat that is dispersed or conducted throughout the rear wall to other portions of the rear wall, away from the particular location of the flue gas air diverter. Such minimal spacing or clearance between the flue gas air diverter and the rear wall can provide additional advantages in that the spacing or clearance can permit air (e.g., small amounts of air or cooling air from within the appliance) to be drawn into a low pressure area of the air gap, for example, from within the appliance housing or from openings in the rear wall, which may provide some cooling of the flue gas air diverter and/or generate a flow of cooler air within the air gap, which may limit or reduce heat transfer from the flue gas air diverter to the rear wall.

The particular location, arrangement, size, shape, and number of flue gas air diverters can vary depending on the particular physical dimensions of one or more components of the appliance, such as an amount of available space between an exit of the exhaust channel and the flue gas air diverter, the oven vent location(s), the number of oven vents or exhaust channels (e.g., oven flues), the air flow through the exhaust channel(s), etc.

The flue gas air diverter can be configured to provide for a smooth flow of air over the surface of the flue gas air diverter and in a direction under a portion of the cooking grates. For example, the flue gas air diverter can be formed as tapered or angled surface, a curved surface, a combination thereof, or the like, to smoothly divert the flow of air over the flue gas air diverter under the cooking grates, which may prevent a build-up of heat at these locations, for example due to stagnant air.

The flue gas air diverter can be positioned such that the flue gas air diverter cannot be viewed readily by a user of the appliance through the opening of the oven vent, to provide the desired aesthetics of the appliance. Particularly, the flue gas air diverter can be at least partially obscured from view by the rear vent trim.

The rear vent trim can include one or more exit openings in communication with the exhaust channel to permit the hot air exhausting from the exhaust channel and being diverted by the flue gas air diverter to flow in a direction under a portion of a cooking grate of the appliance. In an embodiment, the rear vent trim can have a front surface facing toward a front of the housing of the appliance, and the one or more exit openings can be formed in the front surface of the rear vent trim. In some embodiments, the exit openings in the front surface of the rear vent trim can be arranged to be positioned at least partially below a height of an underside of a cooking grate of the appliance, or entirely below the height of the underside of the cooking grate of the appliance.

In an exemplary embodiment, the combination of the flue gas air diverter and the one or more exit openings of the rear vent trim can be configured to divert all or substantially all of the air exhausting from the oven compartment under the cooking grates, to thereby minimize or eliminate an amount of contact between the exhausting hot air and the back wall of the kitchen. One of ordinary skill in the art will recognize that the exemplary flue gas air diverter can be disposed at an angle with respect to the flow of air in the exhaust channel or with respect to the upper surface of the rear vent trim or the exit openings in the rear vent trim that is suitable for diverting the flow of hot exhaust air in a direction under a portion of the cooking grate.

The flue gas air diverter can be a separate component, or coupled to or integrally formed with one or more other components of the appliance. For example, the flue gas air diverter can be integrally formed with the rear vent trim or coupled to the rear vent trim. In another example, the flue gas air diverter can be coupled to or integrally formed on a plate portion, which in turn is coupled to or mounted on the rear wall of the housing without direct physical contact between the plate portion and the rear wall. In order to avoid direct physical contact, the plate portion can include, for example, one or more embosses facing the rear wall. The plate can be arranged such that each emboss is spaced from the rear wall. The appliance can include one or more fasteners for mounting the flue gas air diverter and/or the plate portion to the rear wall of the housing without direct physical contact between the flue gas air diverter and/or the plate portion and the rear wall. For example, each of the fasteners can be coupled to an emboss to mount the flue gas air diverter and/or the plate portion to the rear wall of the housing without direct physical contact between the flue gas air diverter and/or the plate portion and the rear wall.

One of ordinary skill in the art will recognize that the exemplary home cooking appliance is not limited to any particular number of cooking compartments, exhaust channels, flue gas air diverters, or exit openings in the rear vent trim.

The present invention provides a rear vent trim and rear wall assembly that is configured to control an angle of the hot air exiting an exhaust channel of an oven flue of a cooking compartment, and more particularly, to divert the air exiting from the oven flue under a portion of the cooking grate. An exemplary embodiment includes an oven vent trim having one or more flue gas air diverters within the oven vent trim, and within or adjacent to one or more exit openings of the rear vent trim, that optimize and control the flow of air exiting the rear vent trim from the one or more exit openings such that the air flows in a predetermined direction, and particularly in a direction away from the back wall of the kitchen and under a portion of the cooking grate, thereby diverting the hot air (i.e., flue gases) exiting from the cooking compartment under the cooking grates and away from the back wall of the kitchen, which can reduce an amount of heat transferred from the hot air to the back wall of the kitchen, as well as minimize or avoid an impingement on the air flow through the rear vent trim, minimize or avoid a build-up of heat within the rear vent trim, and provide a smooth continuous flow of the air through the rear vent trim. As a result, the present invention can minimize or eliminate a required minimum clearance between the rear wall of the appliance and a back wall of the kitchen, while at the same time maintaining compliance with industry standards and regulations, thereby enabling the home cooking appliance according to the present invention to be installed with a 0" clearance to a combustible surface, such as the back wall of the kitchen, while complying with industry standards and regulations.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1:
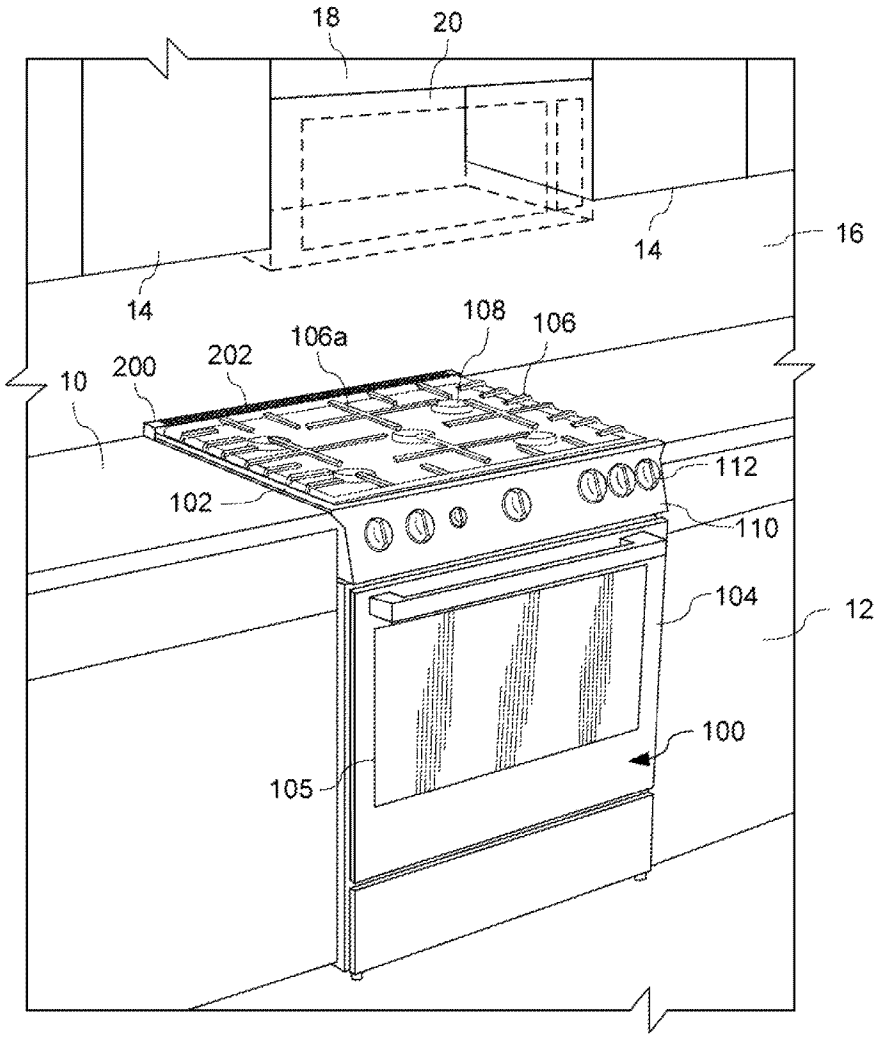
FIG. 1 is a perspective view of a home cooking appliance according to an exemplary embodiment of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-17 illustrate exemplary embodiments of a home cooking appliance having a flue gas air diverter.

Figure 2:
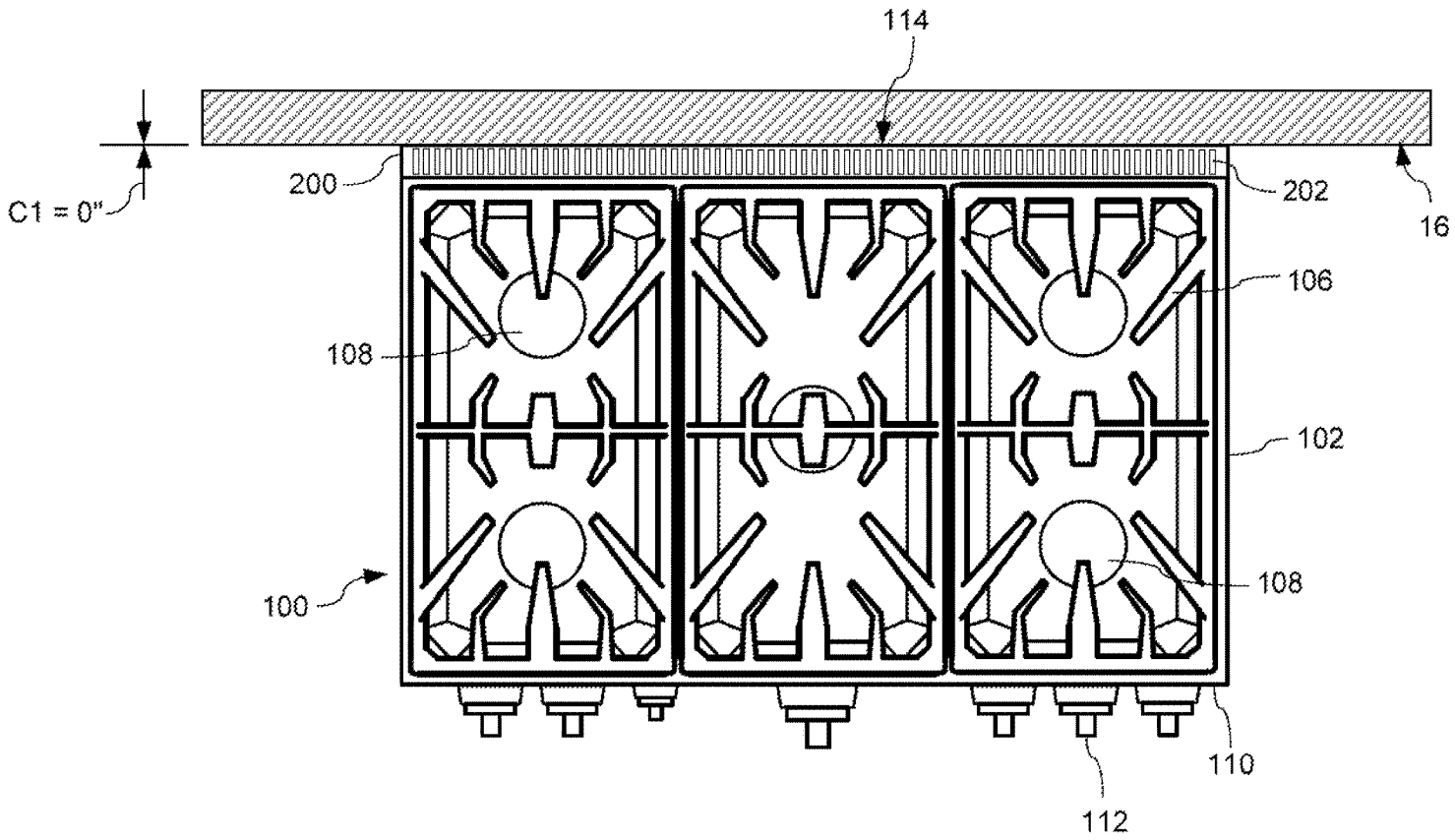
FIG. 2 is a top view of a home cooking appliance according to an exemplary embodiment of the invention.

With reference to FIGS. 1 and 2, example embodiments of a home cooking appliance 100, such as a Free Standing Range (FSR), will first be described. As shown in FIG. 1, the home cooking appliance 100 can include a housing 102 having a cooking compartment, such as a baking oven, convection oven, steam oven, warming drawer, etc., which is accessible through a door 104 in a front of the housing 102. The door 104 can include a door glass 105 for viewing the interior of the cooking compartment. The home cooking appliance 100 has a cooking surface on a top of the housing 102. The cooking surface can include, for example, one or more cooking grates 106 having an upper surface **106*a* for supporting cookware over one or more gas burners 108. The appliance 100 includes a control panel 110 having a plurality of user input features, such as control knobs 112 for controlling the operation of the burners 108** and the cooking compartment. The appliance is not limited to the illustrated embodiments, and can additionally or alternatively include other cooking compartments, such as one or more baking ovens, convection ovens, steam ovens, warming drawers, broil burner, etc., or one or more cooking surfaces, such as a griddle, an induction cooktop with a glass ceramic cooking surface, etc. One of ordinary skill in the art will recognize that the housing can include more than one cooking compartment and more than one door.

As shown in FIGS. 1 and 2, the housing 102 can include a rear vent trim 200 for exhausting air from within the appliance 100, such as cooling air from within the appliance 100 and hot flue gases from the oven cooking compartment. The rear vent trim 200 can take various forms depending on the particular appliance, arrangement of cooking compartment(s), cooktop or burners, desired aesthetics of the appliance, and/or the location in which the appliance will be installed, such as adjacent to a kitchen wall 16, in a kitchen island, adjacent to cabinetry 12, 14, 18, counters 10, or other accessories such as a microwave 20, fume hood, etc., among other things. For example, the rear vent trim 200 can be configured to be raised up from the cooking surface **106*a* by various amounts such as a high back, low back, high shelf, etc., or substantially flush with the top of the appliance 100 or cooking surface 106*a*. In the illustrated example, the housing 102 includes a rear vent trim 200 on the top of the housing 102 and at a rear side of the cooking surface 106. The rear vent trim 200 can be flush with the top of the appliance 100 and include one or more vent openings 202 for exhausting cooling air from within the appliance 100 and one or more openings (not visible in FIGS. 1 and 2) for exhausting flue gases from the oven compartment. The rear vent trim 200 is configured to control and manage the flow of the exhaust air (e.g., hot air/flue gas) to minimize temperatures on a surface of a combustible back wall 16 of the kitchen and/or surfaces adjacent to or above the appliance such as counters 10, kitchen cabinetry 12, 14, 18, microwave 20**, etc.

As shown in FIGS. 1 and 2, the appliance 100 can be configured to be positioned such that a rear wall 114 (of the appliance or of the rear vent trim 200 of the appliance, for example whichever extends furthest rearward) is close to or in contact with a combustible surface, such as a back wall 16 of a kitchen. The temperature of the back wall 16 during operation of the appliance 100, such as operation of the cooking compartment, and particularly a self-cleaning operation of the cooking compartment, greatly affects a required minimum clearance C1 between the rear wall 114 and the back wall 16 of the kitchen. The present invention recognizes that reducing or eliminating a transfer of heat from the hot flue gases, which are exhausted from the rear vent trim 200 during operation of the cooking compartment, to the back wall 16 of the kitchen can reduce a temperature of the back wall 16 of the kitchen, thereby reducing or eliminating a required minimum clearance C1 between the rear wall 114 and the back wall 16 of the kitchen while maintaining compliance with industry standards and regulations.

Figure 3:
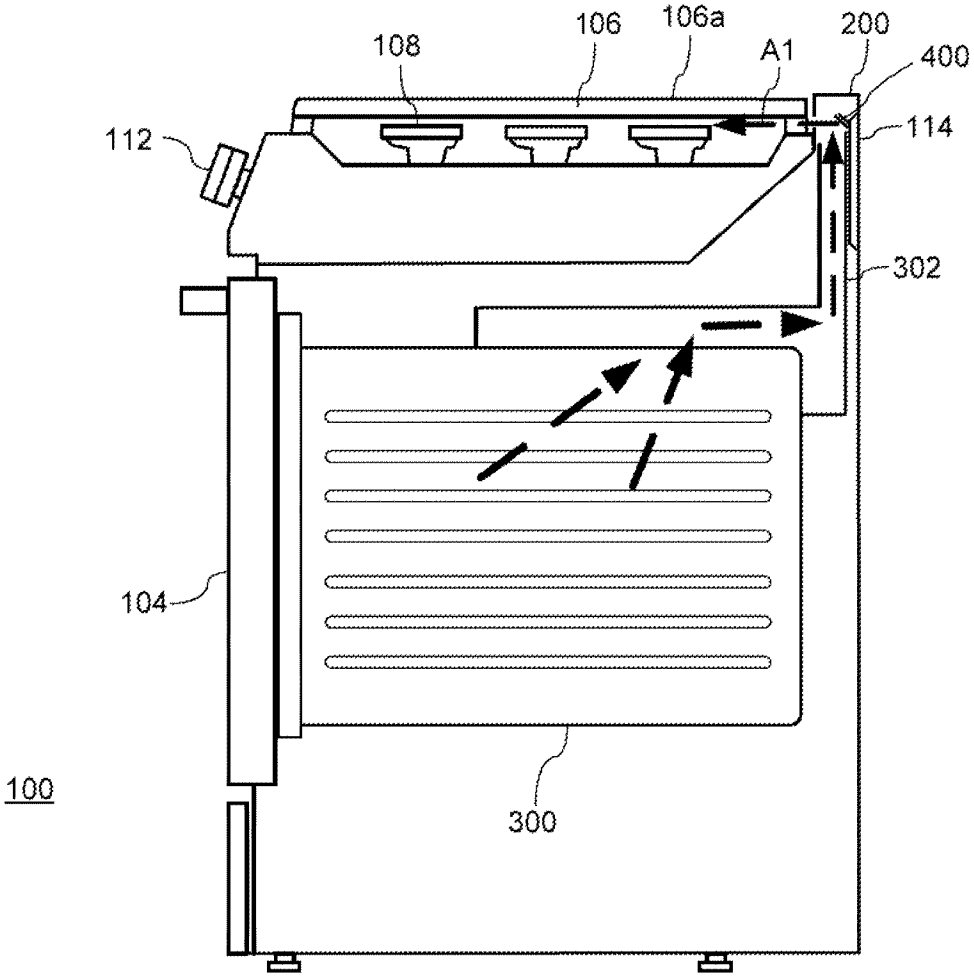
FIG. 3 is a cutaway, side view of a home cooking appliance according to an exemplary embodiment of the invention.
Figure 4:
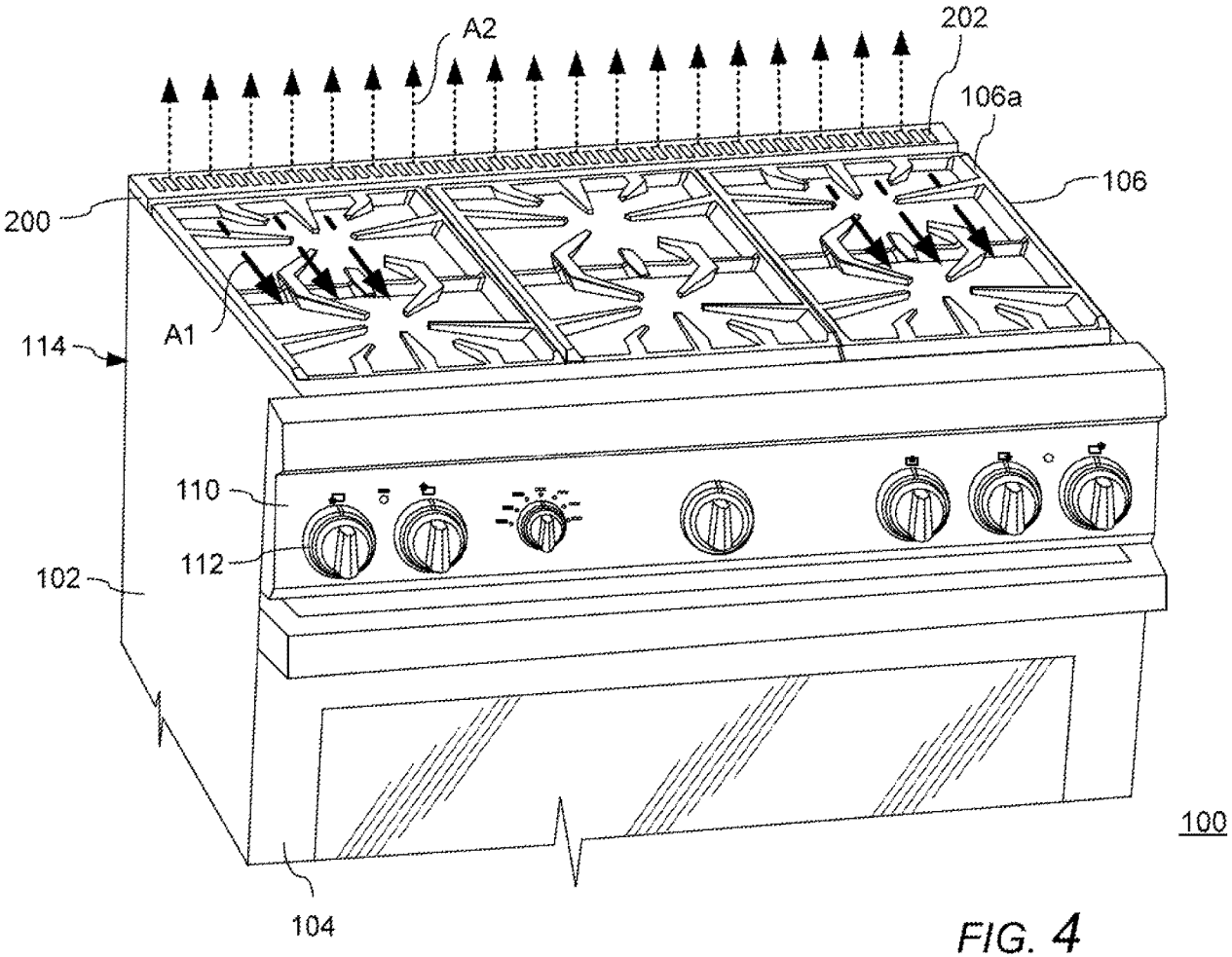
FIG. 4 is a partial perspective view of a home cooking appliance according to an exemplary embodiment of the invention.

With reference to FIGS. 3 and 4, the home cooking appliance 100, and more particularly for example the rear vent trim 200 of the cooking appliance 100, can include one or more flue gas air diverters 400 configured to divert air A1 exiting from one or more exhaust channels 302 (e.g., one or more oven flues) of an oven compartment 300 in a direction under a portion of the cooking grate 106. In this way, the one or more flue gas air diverters 400 can divert hot air A1 (i.e., flue gases) exiting from the cooking compartment 300 under the cooking grates 106 and away from the back wall 16 of the kitchen, thereby reducing or eliminating an amount of heat transferred from the hot air A1 to the back wall 16 of the kitchen, which results in much lower surface temperatures on the back wall 16 of the kitchen during operation of the cooking appliance 100 compared to conventional arrangements, for example, which permit the gas to exit straight upward from the appliance. With reference again to FIG. 2, the exemplary cooking appliance 100 can minimize or eliminate a required minimum clearance C1 between the rear wall 114 and a combustible back wall 16 of the kitchen, while maintaining compliance with industry standards and regulations. More particularly, the exemplary cooking appliance 100 can be installed with a 0" clearance (C1=0") to the back wall 16 of the kitchen, or another combustible surface, while complying with industry standards and regulations.

With reference again to FIG. 4, the rear vent trim 200 having a flue gas air diverter 400 can be configured to divert the flow of the hot air A1 (e.g., hot flue gas) exhausting from the cooking compartment 300 under the cooking grates 106 and away from the back wall 16 of the kitchen while permitting or guiding the cooling air A2 exiting from within the appliance 100 to flow upward from the vent openings 202 of the rear vent trim 200 along the back wall 16 of the kitchen, thereby creating a wash of cooler air A2 that may further prevent the hot air A1 from flowing close to the back wall 16, which may reduce or prevent heat transfer from the hot air A1 to the back wall 16. In this way, the present invention can provide a rear vent trim 200 that controls a flow of hot air A1 exhausting from the cooking compartment 300 of the appliance 100 and a flow of cooling air A2 exiting from within the appliance 100, thereby limiting or reducing the temperature exposure to the back wall 16 of the kitchen. As explained above with reference to FIG. 2, the present invention also can minimize or altogether eliminate a required minimum clearance C1 between the rear wall 114 of the appliance and a back wall 16 of the kitchen, while maintaining compliance with industry standards and regulations, thereby enabling the cooking appliance 100 to be installed with a 0" clearance C1 to the back wall 16 of the kitchen while complying with industry standards and regulations.

One of ordinary skill in the art will recognize that the particular location, arrangement, size, shape, and number of flue gas air diverters 400 can vary depending on the particular physical dimensions of one or more components of the appliance, such as an amount of available space between an exit of the exhaust channel 302 and the flue gas air diverter 400, the exhaust channel 302 location(s), the number of exhaust channels 302 (e.g., oven flues), the air flow through the exhaust channel(s) 302, etc. The flue gas air diverter 400 can be positioned on a surface of the rear wall 114 (e.g., an inner surface of the rear wall), such as a surface that is adjacent to or directly facing the exhaust channel 302. The flue gas air diverter 400 can be mounted directly to the rear wall 114 of the appliance, or spaced from the rear wall 114 and configured to have an air gap between the flue gas air diverter 400 and an inner surface of the rear wall 114 of the appliance. Such an air gap (described in greater detail with reference to FIGS. 14 and 15) can reduce the amount of heat that is transferred from the flue gas air diverter 400 (which is heated by the hot air that flows from the oven compartment through the exhaust channel 302) to the rear wall 114. As a result, during operation of the appliance, a temperature of the rear wall 114 is less than a temperature of the flue gas air diverter 400, which in turn limits or reduces the temperature exposure to a back wall 16 of the kitchen to which the rear wall 114 of the appliance is adjacent. In another example, the flue gas air diverter 400 can be configured to loosely contact the rear wall 114, or to be spaced by a minimal amount or clearance from the rear wall 114 (e.g., entirely spaced apart) using one or more fixation devices. As a result, the heat transfer from one solid to another solid (e.g., metal to metal) can be substantially limited to heat transfer through one or more fixation devices, such as rivets, screws, or the like. In other example embodiments, the flue gas air diverter 400 can be mounted on the appliance such that the flue gas air diverter 400 does not contact, or is substantially free of contact with, the rear wall 114 of the appliance, thereby minimizing or preventing the rear wall 114 from conducting heat from the flue gas air diverter 400. In this way, the exemplary embodiments of the flue gas air diverter 400 can significantly reduce the temperature of the rear wall 114 of the appliance and rear vent trim assembly 200. This arrangement also may limit or reduce an amount of heat that is dispersed or conducted throughout the rear wall 114 to other portions of the rear wall, away from the particular location of the flue gas air diverter 400. Such minimal spacing or clearance between the flue gas air diverter 400 and the rear wall 114 can provide additional advantages in that the spacing or clearance can permit air (e.g., small amounts of air or cooling air from within the appliance) to be drawn into a low pressure area of the air gap, for example, from within the appliance housing 102 or from openings in the rear wall 114, which may provide some cooling of the flue gas air diverter 400 and/or generate a flow of cooler air within the air gap, which may limit or reduce heat transfer from the flue gas air diverter 400 to the rear wall 114.

The flue gas air diverter 400 can be a separate component, or coupled to or integrally formed with one or more other components of the appliance 100. For example, the flue gas air diverter 400 can be integrally formed with the rear vent trim 200 or coupled to the rear vent trim 200. In another example, the flue gas air diverter 400 can be coupled to or integrally formed on another component (such as a plate portion 404 shown in FIGS. 5-7), which in turn is coupled to or mounted on the rear wall 114 of the housing 100, for example, without direct physical contact between the plate portion 404 and the rear wall 114. In an embodiment with more than one flue gas air diverter 400, the flue gas air diverters 400 can be separately formed from each other, integrally formed with each other, or coupled to each other by another component.

Various exemplary embodiments of a flue gas air diverter 400 for an appliance 100 will be described in greater detail below with reference to FIGS. 5-17.

Figure 5:
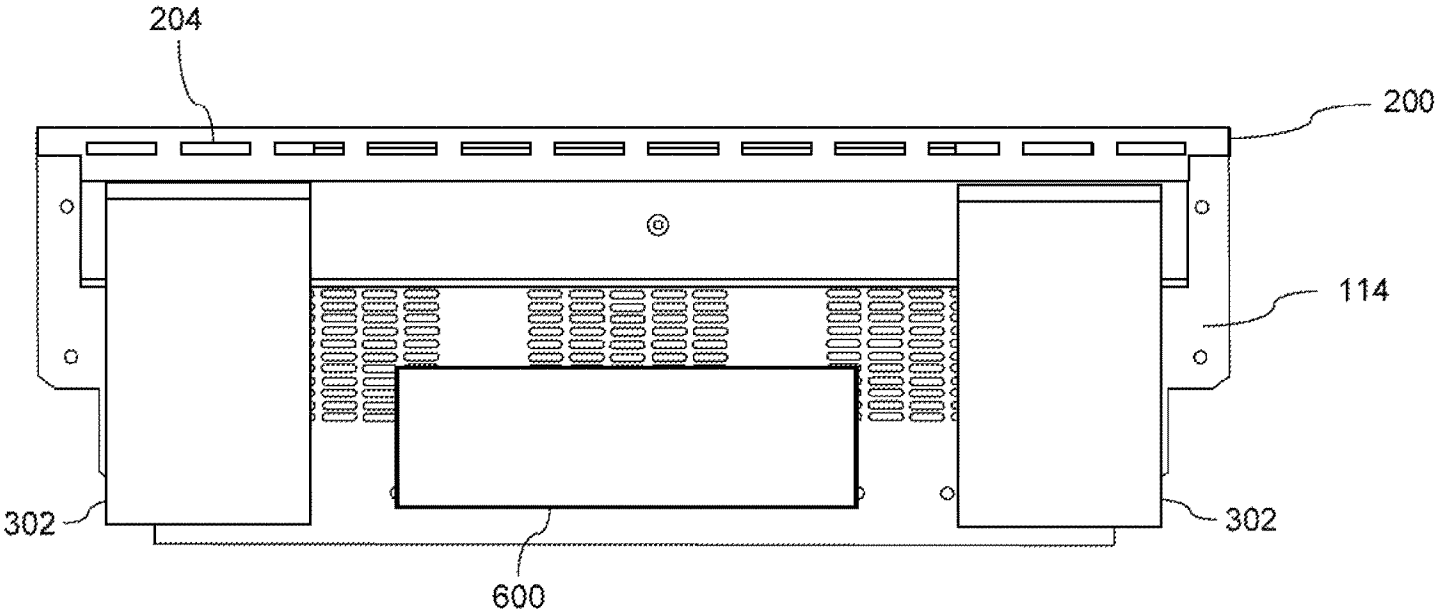
FIG. 5 is a front view of an oven vent trim and rear cover assembly of a home cooking appliance having a flue gas air diverter according to an exemplary embodiment of the invention.

FIGS. 5-10 illustrate an oven vent trim and rear wall assembly of a home cooking appliance 100 according to an exemplary embodiment of the invention. As shown in FIG. 5, the oven vent trim 200 includes a front face having one or more openings 204 for exhausting air (e.g., A1 in FIGS. 3 and 4), such as flue gases, from within the appliance 100 in a direction under the cooking grates. The oven vent trim 200 includes one or more flue gas air diverters 400, each being configured to deflect the air A1 being exhausted from one or more exhaust channels 302 of the oven compartment in a predetermined direction below a portion of a cooking grate (e.g., 106 in FIGS. 3 and 4) of the appliance and away from the back wall 16 of the kitchen. FIG. 5 schematically illustrates a cooling fan 600 for conveying cooling air from within the appliance in an upward direction through the vent openings (e.g., 202 in FIG. 4) in the rear vent trim 200.

Figure 6:
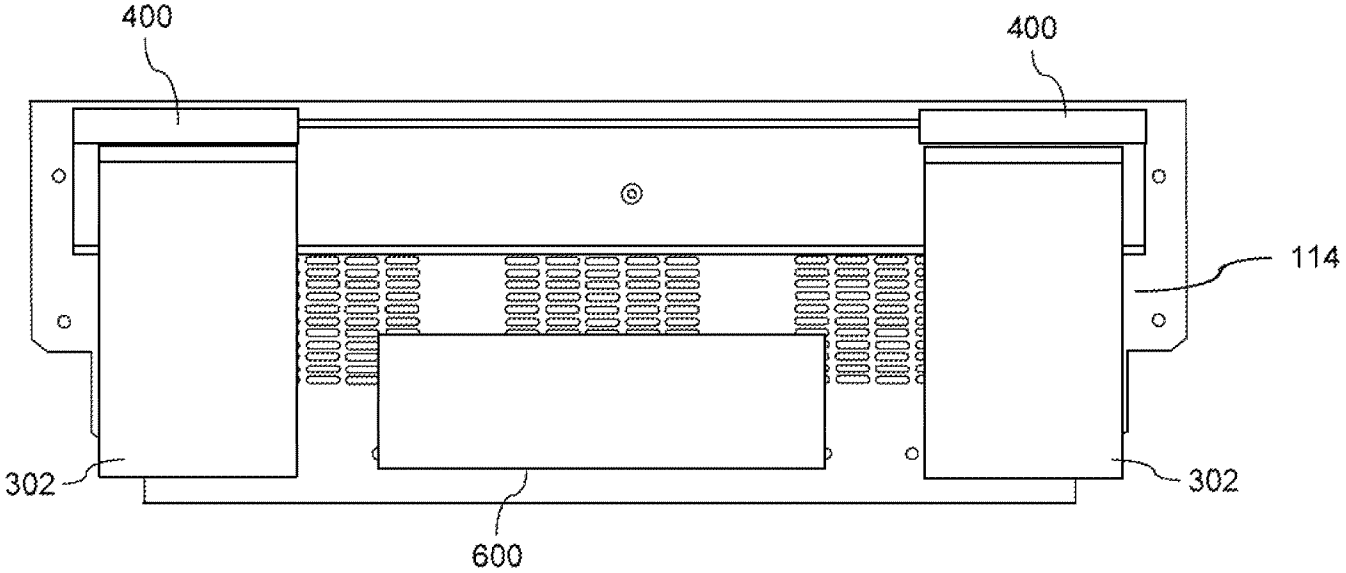
FIG. 6 is another front view of the flue gas air diverter and rear cover assembly of the home cooking appliance of FIG. 5 with the oven vent trim removed for clarity.

FIG. 6 illustrates the assembly of FIG. 5 with the rear vent trim 200 removed to illustrate the interior components. As shown in FIG. 6, the appliance 100 includes one or more flue gas air diverters 400 configured to divert flue gases A1 exiting from one or more oven flues 302 under the cooking grates (e.g., 106 in FIGS. 3 and 4), and thereby away from the back wall 16 of the kitchen. In the example illustrated in FIG. 6, the appliance 100 includes two exhaust channels 302 for exhausting air from the cooking compartment, and a flue gas air diverter 400 for each of the exhaust channels 302. The location of each flue gas air diverter 400 corresponds to, and is limited to, the location of each exhaust channel 302. One of ordinary skill in the art will recognize that any number of flue gas air diverters can be provided depending on the number of oven flues.

Figure 7:
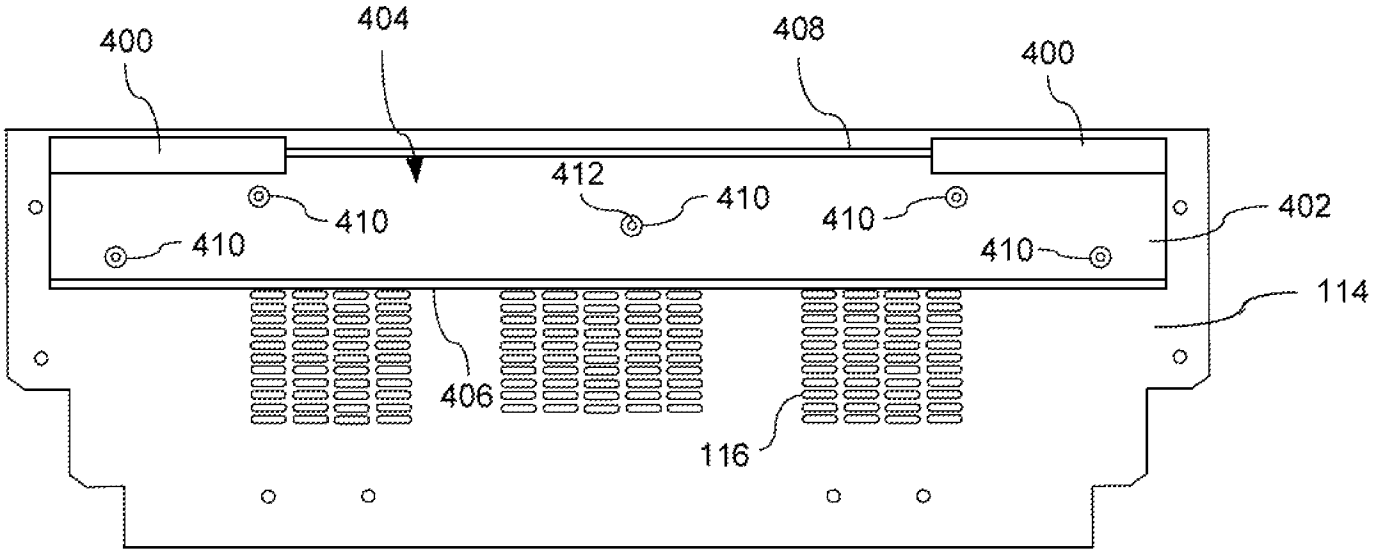
FIG. 7 is another front view of the flue gas air diverter and rear cover assembly of the home cooking appliance of FIGS. 5 and 6 with the oven flues removed for clarity.
Figure 8:
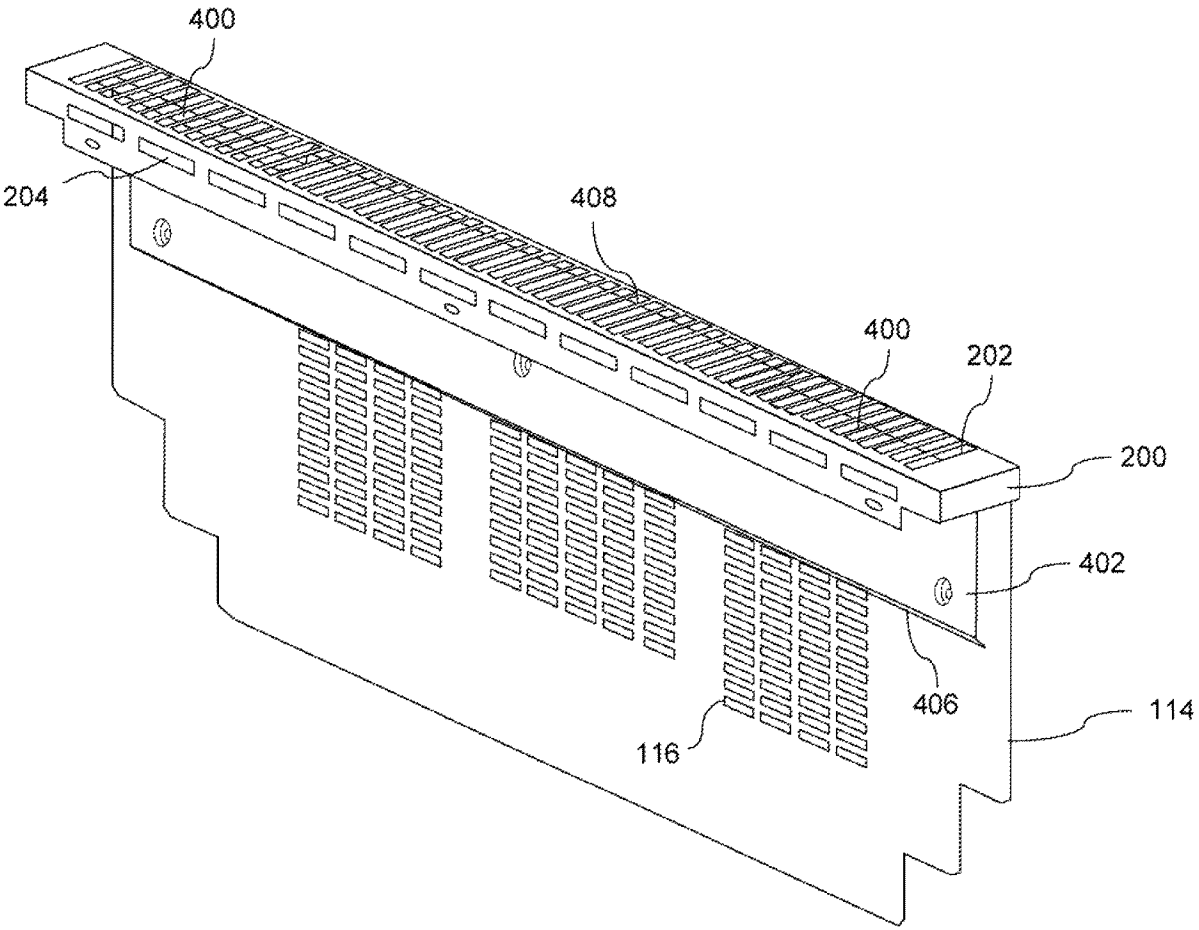
FIG. 8 is a perspective view of an oven vent trim and rear cover assembly of a home cooking appliance having a flue gas air diverter according to an exemplary embodiment of the invention.
Figure 9:
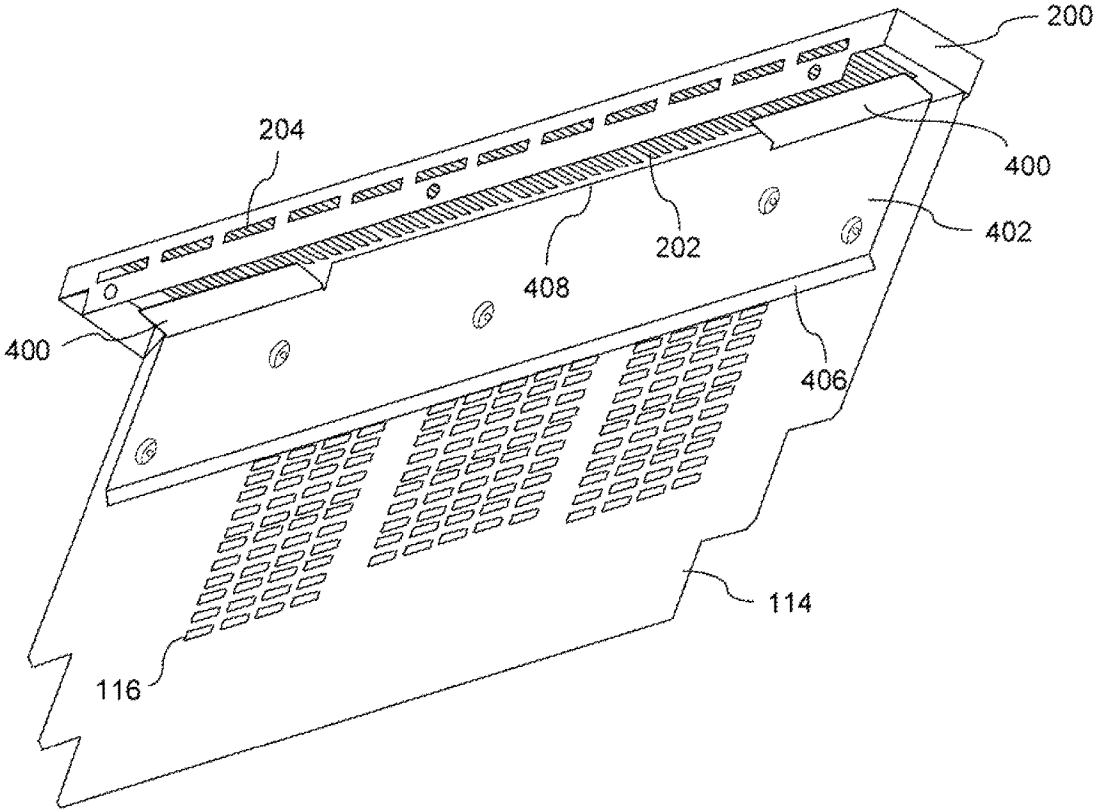
FIG. 9 is a perspective, bottom view of an oven vent trim and rear cover assembly of a home cooking appliance having a flue gas air diverter according to an exemplary embodiment of the invention.
Figure 10:
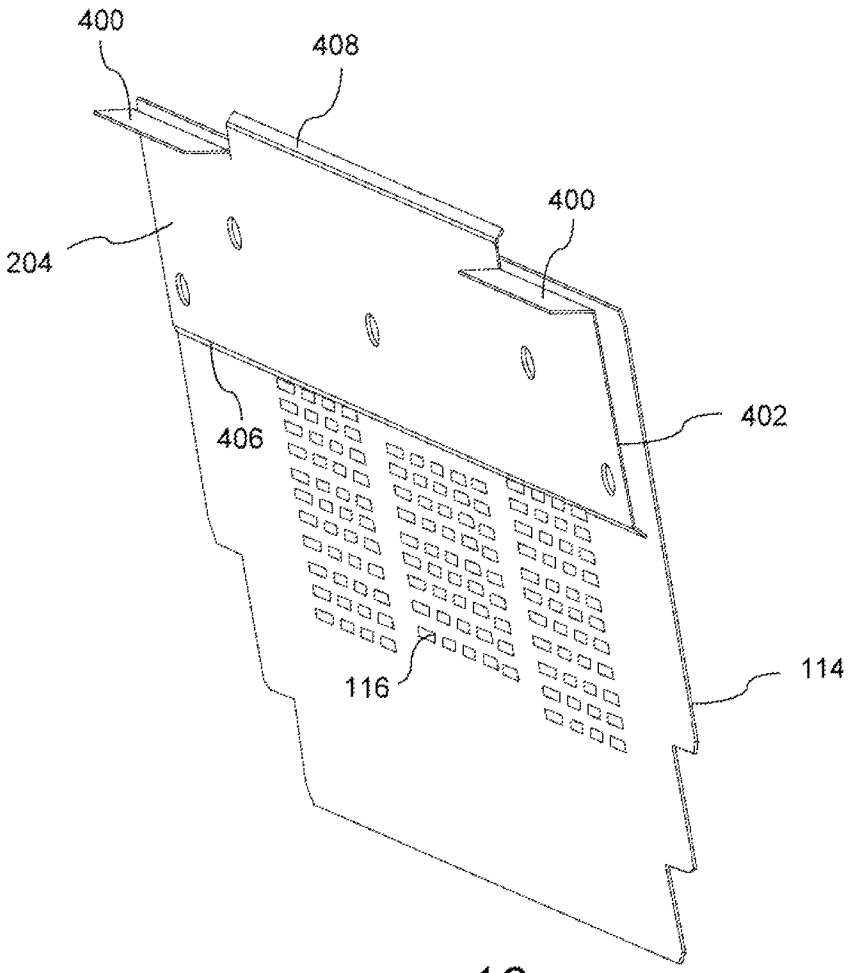
FIG. 10 is a perspective view of the flue gas air diverter and rear cover assembly of the home cooking appliance of FIG. 8 with the rear vent trim removed for clarity.
Figure 11:
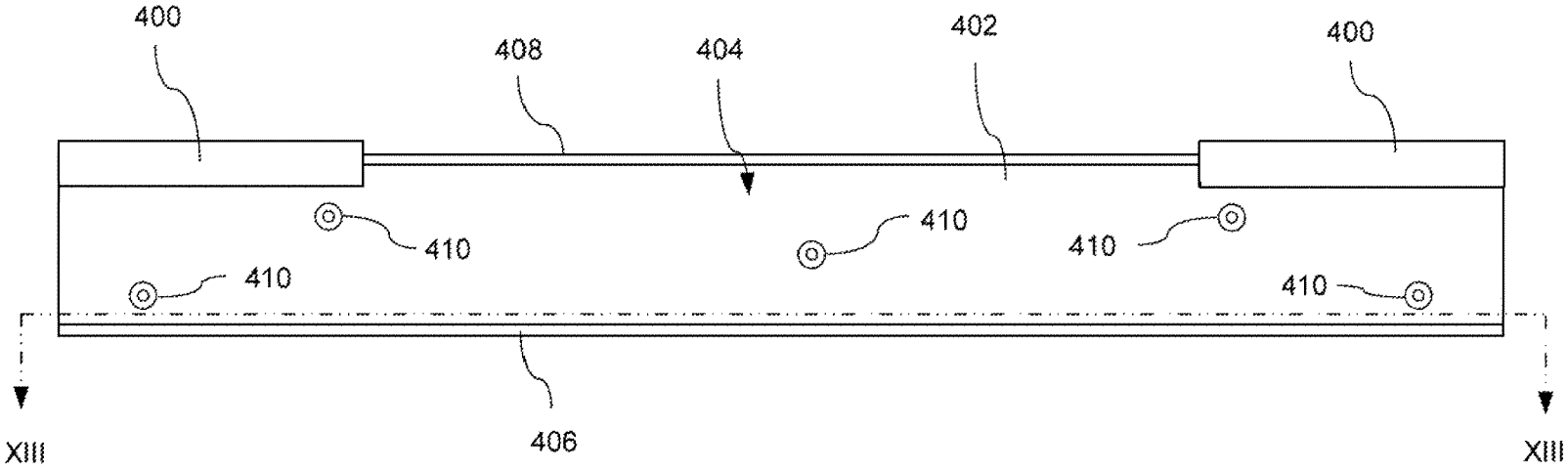
FIG. 11 is a front view of a flue gas air diverter of a home cooking appliance according to an exemplary embodiment of the invention.

FIG. 7 illustrates the assembly of FIGS. 5 and 6 with the rear vent trim 200, the exhaust channels 302, and the cooling air fan 600 removed to illustrate the arrangement of an exemplary embodiment of a flue gas air diverter 400 and details of the rear wall 114, which can include air vent openings 116. The exemplary flue gas air diverter 400 includes a plate portion 404 having a first (upstream) flange 406 and a second (downstream) flange 408, which combine to form an air gap insulator 402. The plate portion 404 includes a plurality of embosses 410 with openings 412 for mounting the flue gas air diverter 400 and/or the plate portion 404 to the rear wall 114 of the housing using fixation devices. These features will be described in greater detail with reference to FIGS. 11-15. FIGS. 8 and 9 illustrate a perspective view of the rear vent trim 200 and rear cover assembly of FIGS. 5-7 having a flue gas air diverter 400 according to an exemplary embodiment of the invention. FIG. 10 illustrates a perspective view of the flue gas air diverter 400 and rear cover assembly of FIGS. 8 and 9 with the rear vent trim 200 removed for clarity.

In the illustrated example shown in FIGS. 5-10, the flue gas air diverters 400 are integrally formed with an air gap insulator 402, which includes a plate portion 404 that is coupled to an inner surface of the rear wall 114. The location of each flue gas air diverter 400 corresponds to, and is limited to, the location of each exhaust channel 302. The part of the plate portion 404 between the exhaust channels 302 and above the cooling air fan (e.g., 600 in FIGS. 5 and 6) do not include flue gas air diverters, thereby permitting cooling air (i.e., A2) to flow upward and exit from the openings (i.e., 202) in the top of the rear vent trim 200. FIGS. 11-15 illustrate an exemplary embodiment of a flue gas air diverter 400 integrally formed with an air gap insulator 402 having a plate portion 404.

Figure 14:
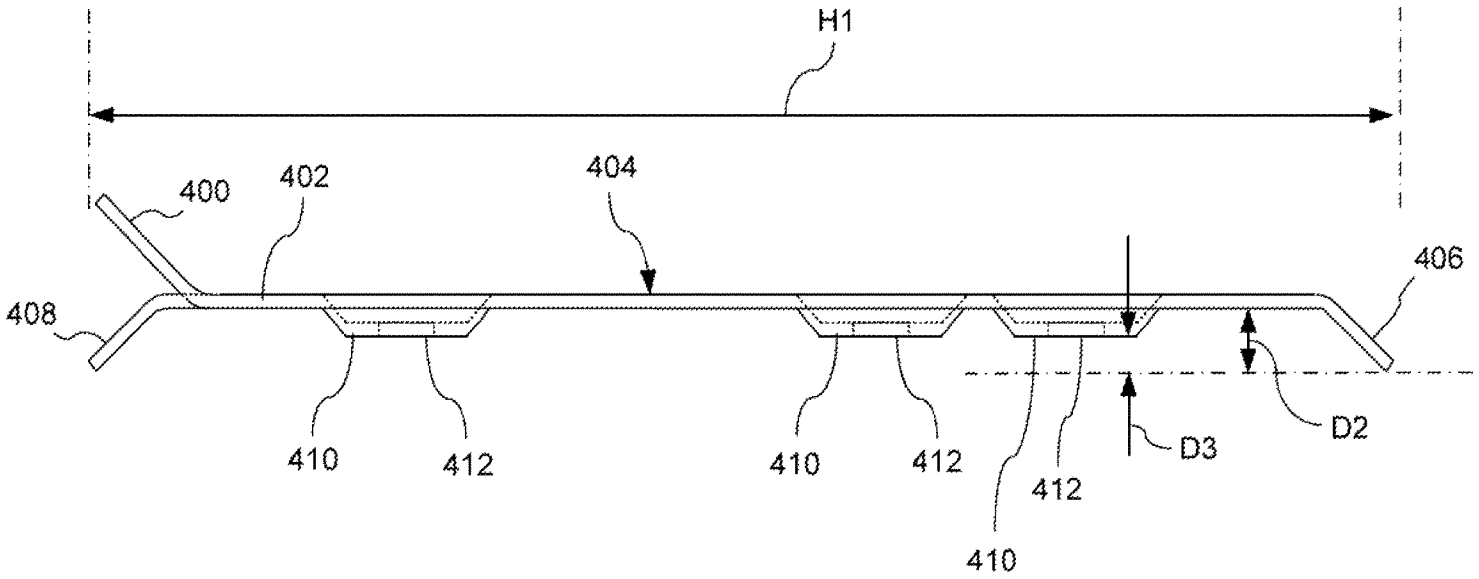
FIG. 14 is an end view of the flue gas air diverter according to the exemplary embodiment illustrated in FIG. 11.
Figure 15:
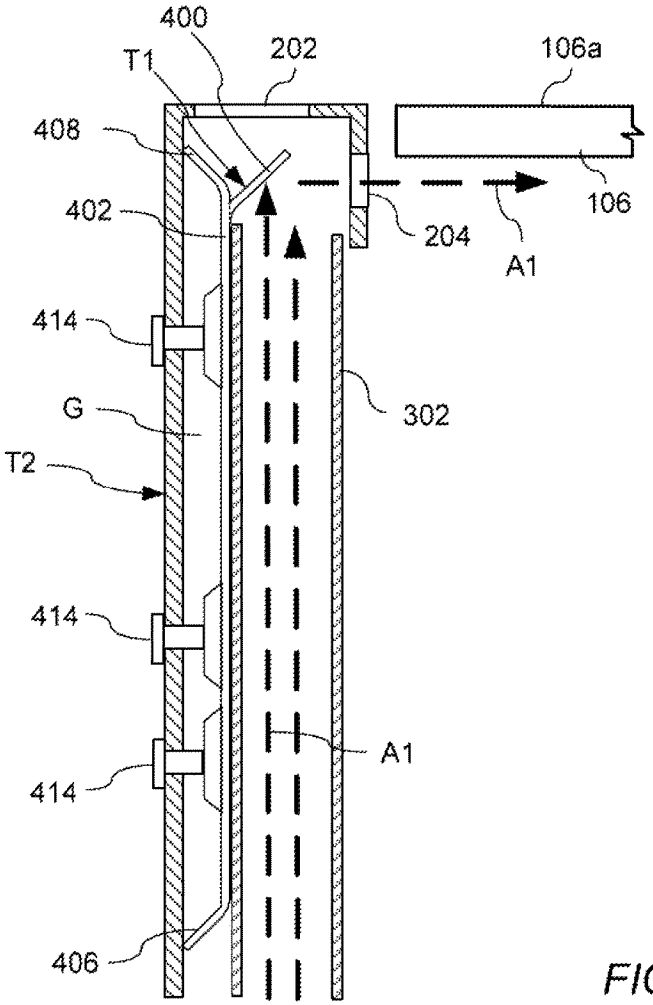
FIG. 15 is a cut-away end view of an oven vent trim and rear cover assembly of a home cooking appliance having a flue gas air diverter according to an exemplary embodiment of the invention.

With reference again to the exemplary embodiment illustrated in FIGS. 5-10 and the exemplary embodiment of the flue gas air diverter 400 in FIGS. 11-15, in order to avoid direct physical contact with the rear wall 114 and thereby reduce or prevent heat transfer from the flue gas air diverter 400 to the rear wall 114, the plate portion 404 can be spaced from an inner surface of the rear wall 114. The plate portion 404 can include, for example, one or more embosses 410 facing the rear wall 114. In an example, the plate portion 404 can be arranged such that each emboss 410 is spaced from the rear wall 114 (as shown in FIGS. 14 and 15). The appliance 100 can include one or more fasteners (e.g., 414 in FIG. 15) for mounting the flue gas air diverter 400 and/or the plate portion 404 to the rear wall 114 of the housing 100 without direct physical contact between the flue gas air diverter 400 and/or the plate portion 404 and the rear wall 114, thereby reducing or preventing heat transfer from the flue gas air diverter 400 to the rear wall 114. For example, each of the fasteners can be coupled to a respective emboss 410 to mount the flue gas air diverter 400 and/or the plate portion 404 to the rear wall 114 of the housing without direct physical contact between the flue gas air diverter 400 and/or the plate portion 404 and the rear wall 114.

The air gap insulator 402 having the flue gas air diverter 400 can include a first flange 406 on an upstream side of the plate portion 404 configured to guide the flow of air over the plate portion 404. The air gap insulator 402 can include a second flange 408 on a downstream side of the plate portion 404 configured to guide the flow of air from the plate portion 404. The first flange 406 can extend along substantially all of, or an entire length of, the plate portion 404. The second flange 408 can extend along a part of the plate portion 404 that does not include the flue gas air diverters 400. The first flange 406 and the second flange 408 can be formed as tapered or angled surfaces, curved surfaces, a combination thereof, or the like, to smooth the flow of air over the air gap insulator 402 and/or prevent a build-up of heat at these locations, for example due to stagnant air. For example, the first flange 406 and/or the second flange 406 can be tapered or angled by substantially 45°. The first flange 406 and the second flange 406 can be tapered by the same amount or a different amount.

The air gap insulator 402 can include one or more elements for mounting the air gap insulator 402, and by extension the flue gas air diverter 400, to the rear wall 114, or another component. For example, as shown in FIG. 7, the air gap insulator 402 can include one or more openings 412 configured to receive a fixation device, such as a rivet, screw, weld, adhesive, or the like (e.g., 414 in FIG. 15). The air gap insulator 402 can include one or more embosses 410 at each opening 412 such that a part of the fixation device, such as a head of a rivet, screw, or the like, can be recessed partly or entirely below the surface 404 to avoid interference with the flow of air over the surface 404. The one or more openings 412 and/or the one or more embosses 410 can have a unique arrangement (e.g., non-symmetrical) that permits installation and assembly of the air gap insulator 402 on the rear wall 114 in only a single possible position, thereby insuring that the air gap insulator can only be installed in the correct position, which may simplify manufacturing and improve quality control.

Figure 12:
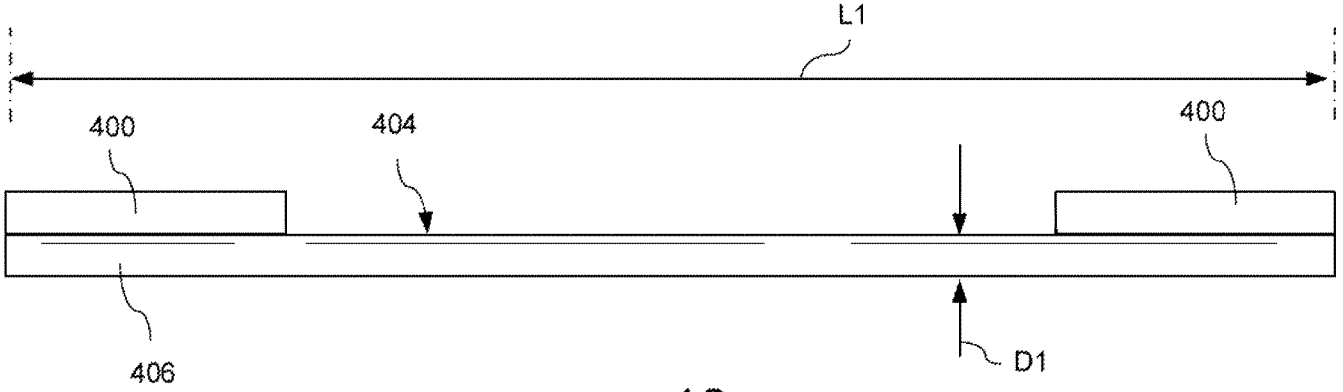
FIG. 12 is a bottom view of the flue gas air diverter according to the exemplary embodiment illustrated in FIG. 11.
Figure 13:
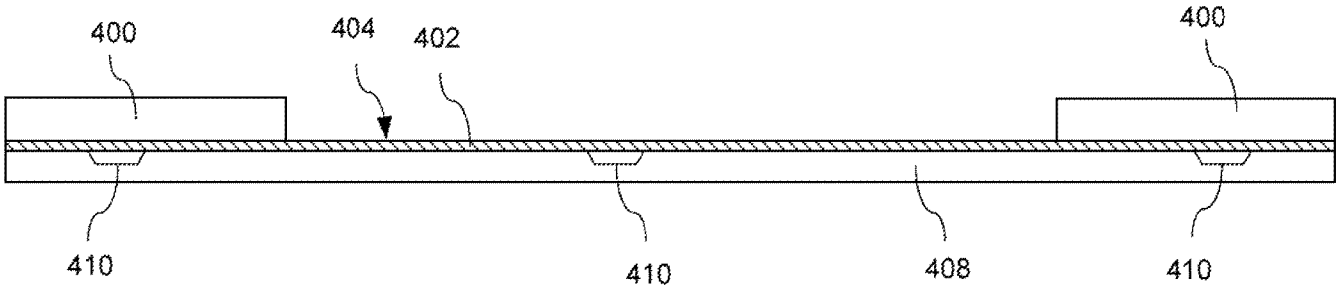
FIG. 13 is a cross-sectional, bottom view of the flue gas air diverter taken along section XIII-XIII in FIG. 11.

With reference to FIG. 12, the air gap insulator 402 having the flue gas air diverter 400 has a depth D1 in a direction perpendicular to the flow of air A1 in the exhaust channel (e.g., 302 in FIG. 15) and perpendicular to the rear wall 114, and a length L1 in a direction perpendicular to the flow of air A1 in the exhaust channel (e.g., 302 in FIG. 15) and parallel to the rear wall 114. With reference to FIG. 14, the air gap insulator 402 has a height H1 in a direction parallel to the flow of air A1 in the exhaust channel (e.g., 302 in FIG. 15).

With reference to FIGS. 14 and 15, the air gap insulator 402 having the flue gas air diverter 400 can be mounted to the rear wall 114 and configured to form an air gap G between the air gap insulator 402 and an inner surface of the rear wall 114 of the appliance, and more particularly, between the plate portion 404 of the air gap insulator 402 and the rear wall 114. The air gap insulator 402 also provides an air gap between the flue gas air diverter 400 and an inner surface of the rear wall 114 of the appliance. In an assembled position, the air gap G has a depth D2 defined by the space between the plate portion 404 and the rear wall 114. The air gap G can reduce the amount of heat that is transferred from the flue gas air diverter 400 (which is heated by the hot air A1 that flows from the oven flue through the exhaust channel) to the rear wall 114. As a result, during operation of the appliance, a temperature T2 of the rear wall 114 is less than a temperature T1 of the flue gas air diverter 400, which in turn limits or reduces the temperature exposure to a back wall 16 of the kitchen to which the wall 114 of the appliance 100 is adjacent. The depth D2 of the air gap insulator 402 can vary depending on the particular physical dimensions of one or more components of the appliance, the oven vent location(s), the number of oven vents or oven flues, the air flow through the exhaust channel, etc.

As shown in FIGS. 14 and 15, the air gap insulator 402 can be mounted to have minimal or limited contact with the rear wall 114 to minimize heat transfer from the air gap insulator 402 and/or the flue gas air diverter 400 to the rear wall 114. For example, the one or more embosses 410 can be spaced from the rear wall 114 by a depth D3 defined by the space between the rear wall 114 and a surface of the emboss 410 facing the rear wall 114. As a result, the heat transfer from one solid to another solid (e.g., metal to metal) can be substantially limited to heat transfer through the one or more fixation devices, such as rivets, screws, or the like (e.g., 414 in FIG. 15).

With reference again to FIGS. 14 and 15, the first flange 406 and second flange 408 can be configured to substantially close off the air gap G from the air A1 flowing in the exhaust channel 300, thereby minimizing or preventing hot air A1 from the exhaust channel from directly contacting the surface of the rear wall 114 adjacent to the air gap G. In some exemplary embodiments, in practice, some contact (e.g., incidental contact) between the edge of each of the first or second flanges 406, 408 and the rear wall 114 is possible within the spirit and scope of the invention.

With reference again to FIGS. 5-10, the rear wall 114 can include one or more openings or vents 116 configured to permit air from outside the appliance to enter the housing 102 of the appliance, for example, for cooling components and/or mixing with hot flue gases. The air vents 116 are illustrated as being positioned below the air gap insulator 402 and the flue gas air diverters 400 in the example embodiment. In other embodiments, additionally or alternatively, one or more air vents 116 can be disposed in the portion of the rear wall 114 adjacent to or directly behind the flue gas air diverter(s) 400 and/or the air gap insulator 402, thereby permitting cooler outside air to be drawn directly into an air gap between the flue gas air diverter 400 and/or air gap insulator 402 and the rear wall 114.

With reference again to FIG. 15, the operation of an exemplary flue gas air diverter 400 will now be described. The rear vent trim 200 can include one or more exit openings 204 in communication with one or more exhaust channels 302 of an oven flue. In an embodiment, the rear vent trim 200 can have a front surface facing toward a front of the housing of the appliance, and the one or more exit openings 204 can be formed in the front surface of the rear vent trim 200. In some exemplary embodiments, the exit openings 204 in the front surface of the rear vent trim 200 can be arranged to be positioned at least partially below a height of an underside of a cooking grate 106 of the appliance 100, or entirely below the height of the underside of the cooking grate 106 of the appliance.

With reference again to FIG. 15, during operation of a heating element in the oven compartment, hot air A1 (e.g., flue gases) flow from the cooking compartment (e.g., 300 in FIG. 3) into the exhaust channel 302, which guides the air A1 upward toward the rear vent trim 200. The flue gas air diverter 400 diverts the upward flow of air A1 in a direction under a portion of a cooking grate 106 of the appliance 100. In an exemplary embodiment, the combination of the flue gas air diverter 400 and the one or more exit openings 204 of the rear vent trim 200 can be configured to divert all or substantially all of the air A1 exhausting from the oven compartment (e.g., 300 in FIG. 3) under the cooking grates 106, to thereby minimize or eliminate an amount of contact between the exhausting hot air A1 and the back wall 16 of the kitchen. One of ordinary skill in the art will recognize that the exemplary flue gas air diverter 400 can be disposed at an angle with respect to the flow of air A1 in the exhaust channel 302 or with respect to the upper surface of the rear vent trim 200 or the exit openings 204 in the rear vent trim 200 that is suitable for diverting the flow of hot exhaust air A1 in a direction under a portion of the cooking grate 106. For example, the flue gas air diverter 400 can be disposed at an angle of 45° with respect to the flow of air A1 in the exhaust channel 302 or with respect to the upper surface of the rear vent trim 200 or the exit openings 204 in the rear vent trim 200. The flue gas air diverter 400 can be configured to provide for a smooth flow of air A1 over the surface of the flue gas air diverter 400 and in a direction under a portion of the cooking grates 106. For example, the flue gas air diverter 400 can be formed as a tapered or angled surface, a curved surface, a combination thereof, or the like, to smoothly divert the flow of air A1 over the flue gas air diverter 400 under the cooking grates 106, which may prevent a build-up of heat at these locations, for example due to stagnant air.

Figure 16:
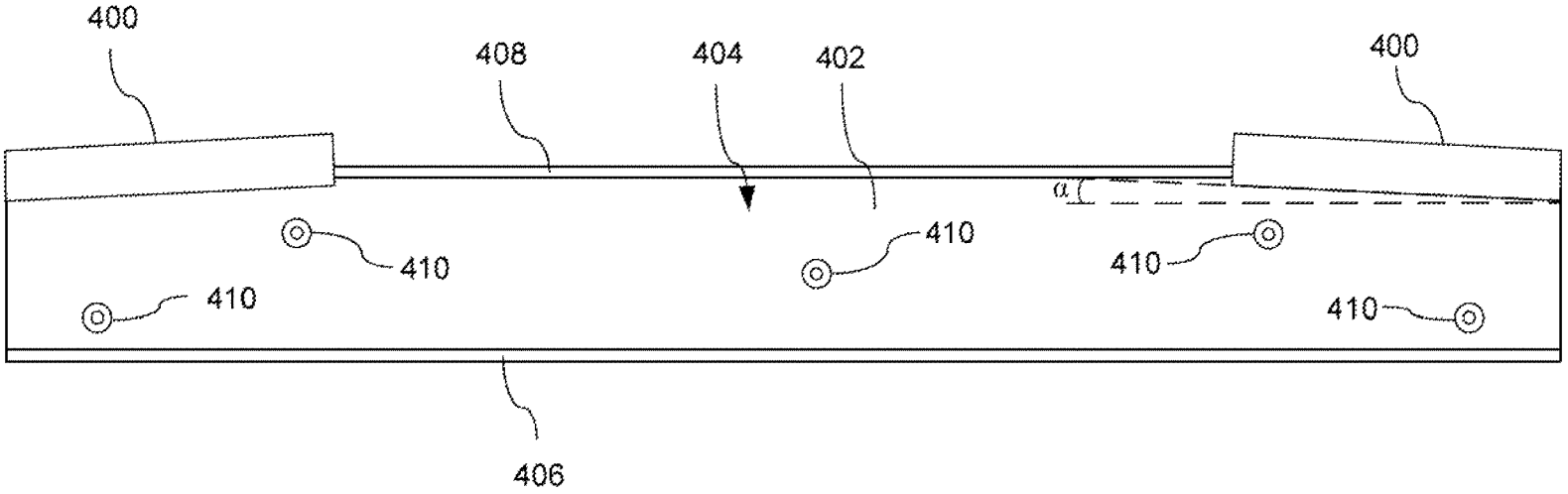
FIG. 16 is a front view of a flue gas air diverter of a home cooking appliance according to another exemplary embodiment of the invention.

With reference to FIG. 16, another exemplary embodiment of an appliance 100 can include one or more flue gas air diverters 400 that are integrally formed with an air gap insulator 402, which includes a plate portion 404 that is coupled to an inner surface of the rear wall 114. When viewed from the front, each of the flue gas air diverters 400 can be angled upward by an angle $\alpha$ in a direction extending from an outer edge of the plate portion 404 toward a central part of the plate portion 404. In this way, each flue gas air diverter 400 can divert the air A1 in a direction under a portion of the cooking grate 106 and toward a central area of the cooktop of the appliance, thereby further limiting or reducing the temperature exposure to a back wall 16 of the kitchen to which the wall 114 of the appliance 100 is adjacent and to adjacent cabinetry or counters (e.g., 10, 12, 14 in FIG. 1) located on either side of the appliance.

Figure 17:
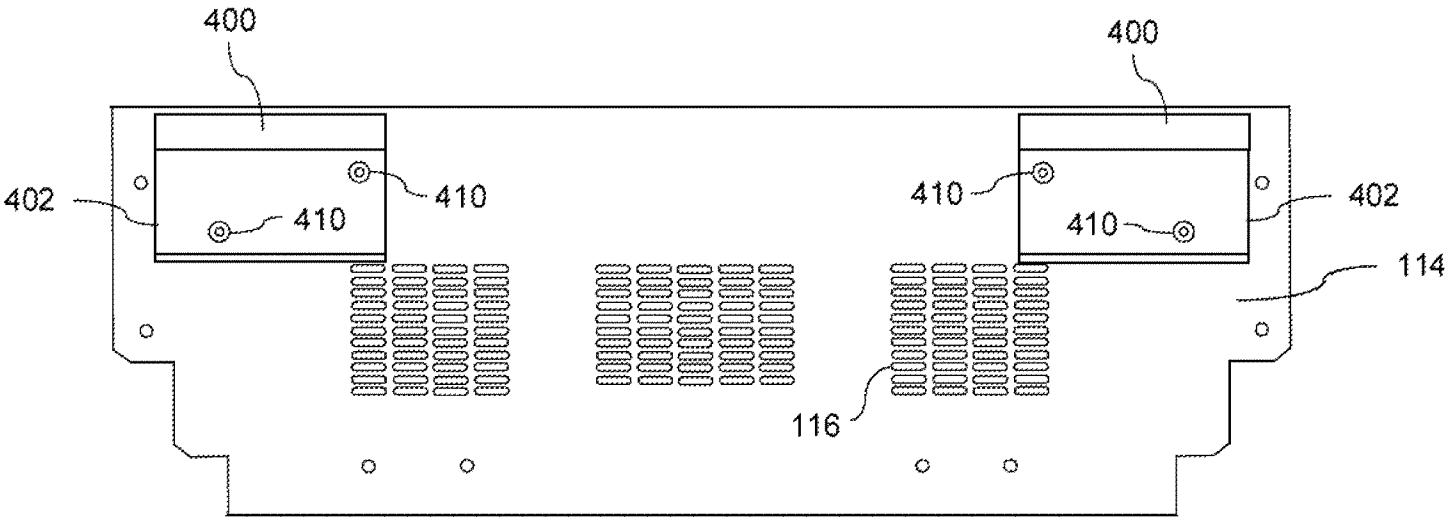
FIG. 17 is a front view of a flue gas air diverter and rear cover assembly of a home cooking appliance according to another exemplary embodiment of the invention.

With reference to FIG. 17, another exemplary embodiment of an appliance 100 can include a plurality of flue gas air diverters 400 that are separately formed from each other and spaced apart from each other. In the example, each of the flue gas air diverters 400 includes a plate portion 404 that is coupled to an inner surface of the rear wall 114. The location of each flue gas air diverter 400 corresponds to, and is limited to, the location of each exhaust channel 302. One of ordinary skill in the art will recognize that the flue gas air diverters 400 can have the same arrangement and configuration at each flue location or different arrangements and configurations.

To summarize, with reference to FIGS. 1-17, an exemplary embodiment of the present invention is directed to a home cooking appliance (e.g., 100) comprising a housing (e.g., 102) having a cooktop surface on a top of the housing (e.g., 102), a burner (e.g., 108) on the cooktop surface, a cooking grate (e.g., 106) disposed above the burner (e.g., 108), a cooking compartment (e.g., 300) in the housing (e.g., 102), an exhaust channel (e.g., 302) that exhausts air from the cooking compartment (e.g., 300), and a flue gas air diverter (e.g., 400) configured to divert the air A1 exiting from the exhaust channel (e.g., 302) under a portion of the cooking grate (e.g., 106).

Another exemplary embodiment of the present invention is directed to a home cooking appliance (e.g., 100) comprising a housing (e.g., 102) having a cooktop surface on a top of the housing (e.g., 102), a burner (e.g., 108) on the cooktop surface, a cooking grate (e.g., 106) disposed above the burner (e.g., 108), a cooking compartment (e.g., 300) in the housing (e.g., 102), an exhaust channel (e.g., 302) that exhausts air from the cooking compartment 300), a rear vent trim (e.g., 200) at a rear side of the top of the housing (e.g., 102), the rear vent trim (e.g., 200) having at least one opening (e.g., 204) formed in a front surface of the rear vent trim (e.g., 200), the at least one opening (e.g., 204) in communication with the exhaust channel (e.g., 302), and a flue gas air diverter (e.g., 400) capable of diverting the air exiting from the exhaust channel (e.g., 302) through the at least one opening (e.g., 204) and under a portion of the cooking grate (e.g., 106).

Yet another exemplary embodiment of the present invention is directed to a home cooking appliance (e.g., 100) comprising a housing (e.g., 102) having a cooktop surface on a top of the housing (e.g., 102), a burner (e.g., 108) on the cooktop surface, a cooking grate (e.g., 106) disposed above the burner (e.g., 108), a cooking compartment (e.g., 300) in the housing (e.g., 102), an exhaust channel (e.g., 302) that exhausts air from the cooking compartment (e.g., 300), and means (e.g., 400) for diverting the air A1 exiting from the exhaust channel (e.g., 302) under a portion of the cooking grate (e.g., 106). The means for diverting the air can include, for example, a plate disposed at an angle with respect to the flow of air A1 in the exhaust channel 302 or with respect to the upper surface of the rear vent trim 200 or the exit openings 204 in the rear vent trim 200. For example, the means for diverting the air can be disposed at an angle of 45° with respect to the flow of air A1 in the exhaust channel 302 or with respect to the upper surface of the rear vent trim 200 or the exit openings 204 in the rear vent trim 200. One of ordinary skill in the art will recognize that means for diverting the air can be provided at other suitable angles. The means for diverting the air can include a planar surface, a curved surface, or combinations thereof for diverting the air under the cooking grate.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A home cooking appliance comprising:

a housing having a cooktop surface on a top of the housing;

a burner on the cooktop surface;

a cooking grate disposed above the burner;

a cooking compartment in the housing;

an exhaust channel that exhausts air from the cooking compartment out of the housing; and a flue gas air diverter configured to divert the air exiting the housing from the exhaust channel under a portion of the cooking grate, wherein the flue gas air diverter is on a plate portion, the plate portion being coupled to a rear wall of the housing without direct physical contact between the plate portion and the rear wall, and including an emboss facing the rear wall, the emboss being spaced from the rear wall.

2. The home cooking appliance of claim 1, further comprising:

a rear vent trim at a rear side of the top of the housing, the rear vent trim having at least one opening in communication with the exhaust channel, the at least one opening configured to permit the air exiting the housing from the exhaust channel to flow under the portion of the cooking grate.

3. The home cooking appliance of claim 2, wherein the rear vent trim has a front surface facing toward a front of the housing, and wherein the at least one opening of the rear vent trim is formed in the front surface of the rear vent trim.

4. The home cooking appliance of claim 3, further comprising:

a cooling fan, wherein the rear vent trim has an upper surface including a vent opening for exhausting cooling air from the cooling fan upward from the rear vent trim.

5. The home cooking appliance of claim 1, wherein the flue gas air diverter is positioned on a surface of a rear wall of the housing that faces the exhaust channel.

6. The home cooking appliance of claim 1, wherein the flue gas air diverter is coupled to a rear wall of the housing without direct physical contact between the flue gas air diverter and the rear wall.

7. The home cooking appliance of claim 6, further comprising:

a fastener for mounting the flue gas air diverter to the rear wall of the housing without direct physical contact between the flue gas air diverter and the rear wall.

8. The home cooking appliance of claim 1, further comprising:

a fastener for mounting the flue gas air diverter to the rear wall of the housing without direct physical contact between the flue gas air diverter and the rear wall.

9. The home cooking appliance of claim 4, wherein the flue gas air diverter is disposed at an angle with respect to the upper surface of the rear vent trim.

10. The home cooking appliance of claim 1, further comprising:

a second exhaust channel that exhausts air from the cooking compartment; and a second flue gas air diverter configured to divert the air exiting from the second exhaust channel under a second portion of the cooking grate.

11. The home cooking appliance of claim 10, wherein the exhaust channel is spaced from the second exhaust channel.

12. The home cooking appliance of claim 10, further comprising:

a rear vent trim at a rear side of the top of the housing, the rear vent trim having a plurality of openings, wherein a first opening of the plurality of openings is in communication with the exhaust channel, the first opening configured to permit the air exiting from the exhaust channel to flow under the portion of the cooking grate, and wherein a second opening of the plurality of openings is in communication with the second exhaust channel, the second opening configured to permit the air exiting from the second exhaust channel to flow under the second portion of the cooking grate.

13. The home cooking appliance of claim 12, wherein the rear vent trim has a front surface facing toward a front of the housing, and wherein the first opening and the second opening of the rear vent trim are formed in the front surface of the rear vent trim.

14. The home cooking appliance of claim 13, further comprising:

a cooling fan, wherein the rear vent trim has an upper surface including a plurality of vent openings for exhausting cooling air from the cooling fan upward from the rear vent trim.

15. The home cooking appliance of claim 1, wherein the flue gas air diverter includes a flange disposed at an angle above an exit of the exhaust channel, the flange configured to divert the air exiting upward from the exhaust channel in a direction under the portion of the cooking grate and toward a front of the appliance.

16. The home cooking appliance of claim 1, wherein the flue gas air diverter includes a plate disposed at an angle above an exit of the exhaust channel, the plate configured to divert the air exiting upward from the exhaust channel in a direction under the portion of the cooking grate and toward a front of the appliance.

17. A home cooking appliance comprising:

a housing having a cooktop surface on a top of the housing;

a burner on the cooktop surface;

a cooking grate disposed above the burner;

a cooking compartment in the housing;

an exhaust channel that exhausts air from the cooking compartment;

a rear vent trim at a rear side of the top of the housing, the rear vent trim having at least one opening formed in a front surface of the rear vent trim, the at least one opening in communication with the exhaust channel; and a flue gas air diverter capable of diverting the air exiting from the exhaust channel through the at least one opening and under a portion of the cooking grate, wherein the flue gas air diverter is on a plate portion that is disposed between an exterior rear wall of the housing and a front wall of the exhaust channel and that forms an air gap between the plate portion and the exterior rear wall of the housing, wherein the plate portion includes:

a first flange on an upstream side of the plate portion with respect to a flow of the air through the exhaust channel; and a second flange on a downstream side of the plate portion with respect to the flow of the air through the exhaust channel, wherein the plate portion, the first flange, and the second flange cooperate with the exterior rear wall to form the air gap.

18. The home cooking appliance of claim 17, further comprising:

a second exhaust channel that exhausts air from the cooking compartment, wherein the rear vent trim has at least one additional opening formed in the front surface of the rear vent trim, the at least one additional opening in communication with the exhaust channel; and a second flue gas air diverter capable of diverting the air exiting from the exhaust channel through the at least one additional opening and under a second portion of the cooking grate, wherein the exhaust channel is spaced from the second exhaust channel.

19. A home cooking appliance comprising:

a housing having a cooktop surface on a top of the housing;

a burner on the cooktop surface;

a cooking grate disposed above the burner;

a cooking compartment in the housing;

an exhaust channel that exhausts air from the cooking compartment; and means for diverting the air exiting from the exhaust channel under a portion of the cooking grate, wherein the means for diverting is on a plate portion that is disposed between an exterior rear wall of the housing and a front wall of the exhaust channel and that forms an air gap between the plate portion and the exterior rear wall of the housing, wherein the plate portion includes:

a first flange on an upstream side of the plate portion with respect to a flow of the air through the exhaust channel; and a second flange on a downstream side of the plate portion with respect to the flow of the air through the exhaust channel, wherein the plate portion, the first flange, and the second flange cooperate with the exterior rear wall to form the air gap.

20. The home cooking appliance of claim 2, wherein the rear vent trim has an upper surface that is substantially flush with an upper surface of the cooking grate.

21. The home cooking appliance of claim 3, wherein the rear vent trim further comprises an upper surface that is substantially flush with an upper surface of the cooking grate.

22. The home cooking appliance of claim 1, wherein the flue gas air diverter is on a plate portion, the plate portion is disposed between an exterior rear wall of the housing and a front wall of the exhaust channel, and the plate portion forms an air gap between the plate portion and the exterior rear wall of the housing.

23. The home cooking appliance of claim 22, wherein the plate portion is coupled to the exterior rear wall of the housing without direct physical contact between the plate portion and the exterior rear wall of the housing.

24. A home cooking appliance comprising:

a housing having a cooktop surface on a top of the housing;

a burner on the cooktop surface;

a cooking grate disposed above the burner;

a cooking compartment in the housing;

an exhaust channel that exhausts air from the cooking compartment out of the housing; and a flue gas air diverter configured to divert the air exiting the housing from the exhaust channel under a portion of the cooking grate, wherein the flue gas air diverter is on a plate portion, the plate portion is disposed between an exterior rear wall of the housing and a front wall of the exhaust channel, and the plate portion forms an air gap between the plate portion and the exterior rear wall of the housing, and wherein the plate portion includes:

a first flange on an upstream side of the plate portion with respect to a flow of the air through the exhaust channel; and a second flange on a downstream side of the plate portion with respect to the flow of the air through the exhaust channel, wherein the plate portion, the first flange, and the second flange cooperate with the exterior rear wall to form the air gap.

25. The home cooking appliance of claim 22, wherein the flue gas air diverter includes a plate disposed at an angle with respect to the plate portion and above an exit of the exhaust channel, the plate configured to divert at least a portion of the air exiting upward from the exhaust channel in a direction under the portion of the cooking grate and toward a front of the appliance.

26. The home cooking appliance of claim 1, further comprising:

a rear vent trim forming an exterior rear edge of the top of the housing, the rear vent trim having an upper surface that is substantially flush with an upper surface of the cooking grate and having at least one opening in communication with the exhaust channel, the at least one opening configured to permit the air exiting from the exhaust channel and diverted by the flue gas air diverter to flow under the portion of the cooking grate.

27. The home cooking appliance of claim 26, wherein the flue gas air diverter is positioned on an interior surface of an exterior rear wall of the housing, the interior surface facing forward toward the exhaust channel.

28. A home cooking appliance comprising:

a housing having a cooktop surface on a top of the housing;

a burner on the cooktop surface;

a cooking grate disposed above the burner;

a cooking compartment in the housing;

an exhaust channel that exhausts air from the cooking compartment; and a flue gas air diverter configured to divert the air exiting from the exhaust channel under a portion of the cooking grate, wherein the flue gas air diverter is positioned on an interior surface of an exterior rear wall of the housing, the interior surface facing forward toward the exhaust channel.

* * * * *